United States Patent [19]

Sams

[11] Patent Number: 4,779,825

[45] Date of Patent: Oct. 25, 1988

[54] AERODYNAMIC DEVICES

[76] Inventor: Kenneth Sams, 88 Boileau Rd., London, England, W5 3AL

[21] Appl. No.: 21,116

[22] Filed: Mar. 3, 1987

[30] Foreign Application Priority Data

Sep. 23, 1986 [GB] United Kingdom ..... 8622853

[51] Int. Cl.[4] ..... B64C 31/06

[52] U.S. Cl. ..... 244/153 A

[58] Field of Search ..... 244/39, 10, 21, 153 A, 244/154, 91, 153 R; D 21/85, 86, 88, 89

[56] References Cited

U.S. PATENT DOCUMENTS

| | | | |
|---|---|---|---|
| 1,763,257 | 6/1930 | Roscoe | 244/91 |
| 3,079,115 | 2/1963 | Edwards Jr. et al. | 244/153 A |
| 3,267,656 | 7/1966 | Boehler et al. | 244/39 |
| 3,439,887 | 4/1969 | Boehler et al. | 244/153 A |
| 3,469,807 | 9/1969 | Morris, Jr. | 244/91 |
| 4,243,190 | 1/1981 | Sams | 244/39 |

*Primary Examiner*—Galen Barefoot

*Attorney, Agent, or Firm*—Flynn, Thiel, Boutell & Tanis

[57] ABSTRACT

An aerodynamic device includes a rotor connected, for rotation about an axis, by bearings to a bridle to which a securing line is attached. At least one stabilizer fin is hinged to the rotor on an axis at right angles to the rotation axis. Each stabilizer fin is free to move angularly about its hinge axis in flight.

15 Claims, 4 Drawing Sheets

AERODYNAMIC DEVICES

BACKGROUND OF THE INVENTION

The present invention relates to aerodynamic devices having a rotor coupled to retaining means which define an axis of rotation for the rotor.

PRIOR ART

Examples of such devices are described in British Patent specification No. 2037170 and International Patent specification No. WO 85/05086.

According to the invention there is provided an aerodynamic device having a rotor coupled to retaining means which define an axis of rotation for the rotor, wherein a stabiliser fin is hinged to the rotor for free angular movement about a hinge axis which lies in a plane normal to the axis, the arrangement being such that in flight the stabiliser fin is free to move under effect of centrifugal and aerodynamic forces.

I have found that with this arrangement, such devices fly better than devices with stabilisers which are fixed.

Embodiments of the invention will now be described by way of example with reference to the accompanying drawings in which:

DESCRIPTION OF THE EMBODIMENTS

Figure 1:
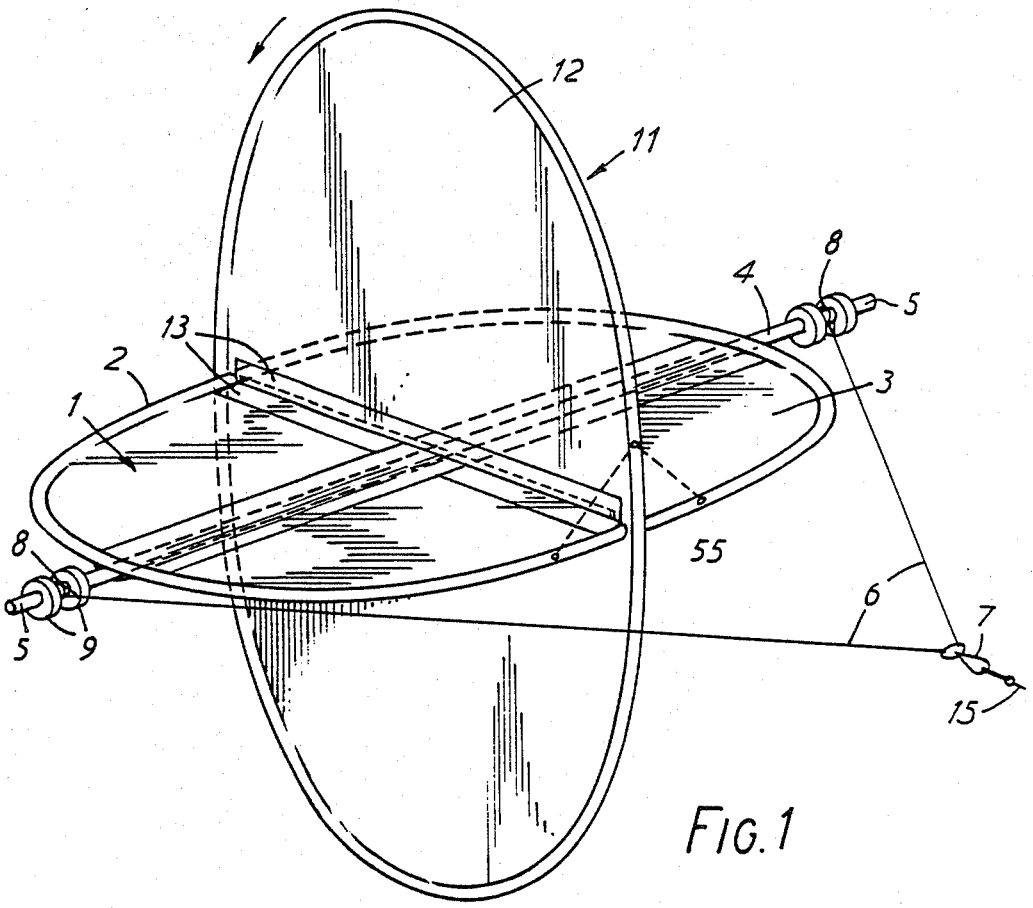
FIGS. 1 to 4 each show a view in perspective of a respective aerodynamic device.

The device shown in FIG. 1 comprises a flat wing 1 having a peripheral frame 2 formed from glass-fibre-reinforced rod and having a substantially elliptical shape. A wing covering 3 of thin plastics film, advantageously MYLAR is secured around its edges to the frame 2, conveniently by means af adhesive tape which may also by of MYLAR.

A stiff rod 4, again conveniently of glass-fibre-reinforced plastics material, is secured along the major diameter thereof with its ends 5 projecting beyond the frame 2. A bridle 6 is formed from two lengths of nylon line extending from a loop 7 to loops 8 which are held captive on the rod ends 5 by a pair of washers 9 cermented to the rod end 5 on either side of the loop 8 with sufficient clearance to enable the rod 4 to turn freely in the loops 8. The two lengths of the bridle 6 may in fact be formed by a single length of nylon line with the loop 7 being formed by a suitable knot.

A stabiliser plane 11 is of similar construction to the wing 1 but has its small diameter somewhat larger than that of the wing 1. The wing 1 is inserted through a slit formed in the covering 3 of the stabiliser plane 11 along the smallest diameter of the stabiliser plane and has its covering 12 hinged to the covering 3 by strips 13 of adhesive MYLAR tape. The wing 1 and stabiliser plane 11 are secured together prior to the rod being passed through a central hole in the covering 12.

When not in use, the stabiliser plane 11 can lie flat against the wing 1. When it is desired to fly the device in a wind, the end of a line 15 on a reel (not shown, and advantageously on a fishing rod or like pole) is attached to the loop 7 and the device thrown into the air. As the rotor begins to rotate about the axis of the rod 4, the stabiliser plane 11 swings about its hinge axis to a position normal to the plane of the wing 1.

In a modified form of the embodiment shown in FIG. 1, the ring 1 and stabiliser plane 11 (which in flight forms two stabiliser fins) are made of thin rigid foamed plastics material. The peripheral frames such as the frame 2 are then not required but the rod 4 is still required to provide the necessary stiffness. Two separate fins may be independently hinged to opposite sides of the wing 1.

Figure 2:
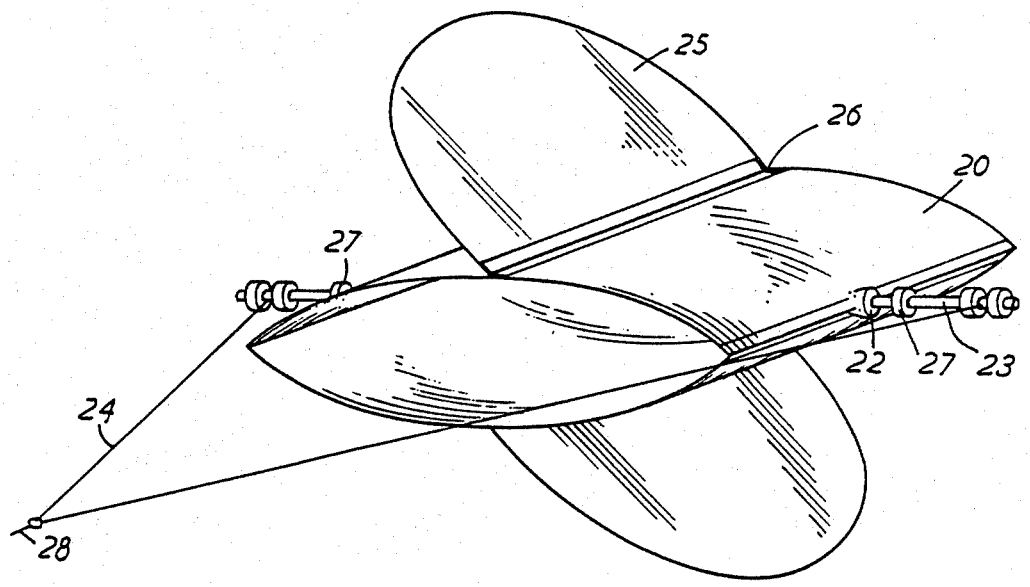

In the embodiment shown in FIG. 2, the rotor 20 is tubular and is made of two sheets of stiff but resilient plastics material which are secured together along their ends 21 by adhesive tape to form a flatten tube. A nylon bush 22 is secured at the mid point of each edge 21 and a stiff rod 23 passes freely through both bushes 22 so that its ends project on each side of the rotor to carry a bridle 24 in a similar manner to that shown in FIG. 1.

A stabiliser fin 25 is hinged to the centre of each half of the tubular rotor 20 along axes lying in a plane normal to the axis of the rod 23 by means of adhesive tape 26.

To centralise the rotor on the rod 23, collars 27 are cemented to the rod.

For transport, the stabiliser fins 25 can be folded flat on the surfaces of the rotor 20 which itself can be flattened as a result of the resilience of the material of the rotor walls and the flexibility of the tape 21. In that state, the device can be conveniently packed in a flat bag.

When removed from the bag for use, the rotor adopts the flattened tubular shape shown in FIG. 2. When flown in a wind, as the rotational speed of the rotor increases, the rotor can expand in the direction at right angles to the rod 23 towards a cylindrical shape. As the rotor begins to spin, the stabiliser fins 25 automatically move out to lie in the plane at right angles to the axis of the rod 23.

The fins 12, FIG. 1 or 25, FIG. 2 may be modified to be double-walled and constructed so as to be inflatable. Advantageously they are then filled with a lighter-than-air gas such as helium.

Figure 3:
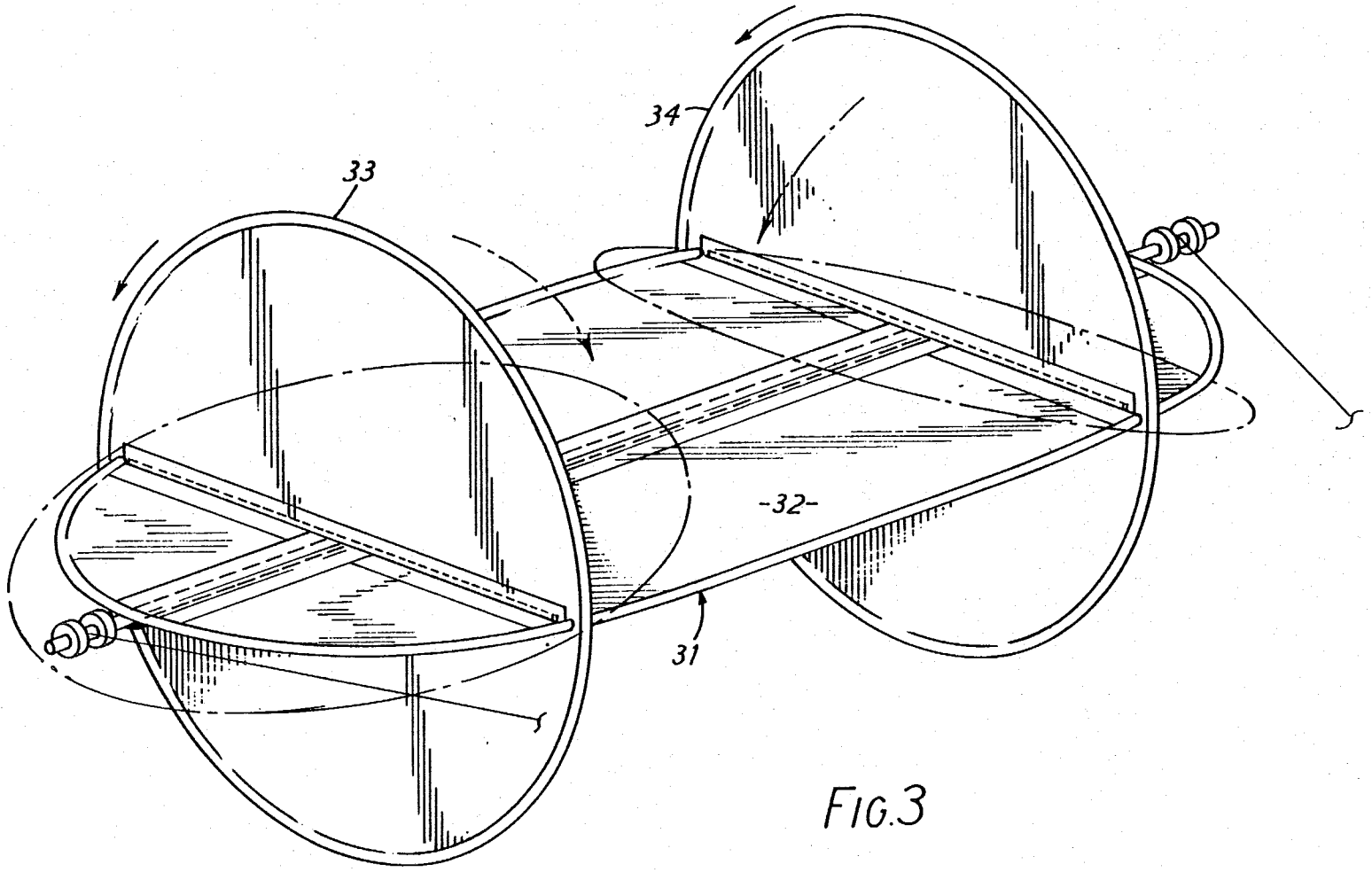

In the modified form of the device shown in FIG. 3, the length of the wing 31 is increased by a parallel-sided central portion 32 and the device has two stabiliser planes 33 and 34 (which in a further modification may be inflatable as described above) one adjacent each end of the central portion 32 of the wing with the end portions 35 and 36 of the latter extending beyond the stabiliser planes. The stabiliser planes (also the plane 11 in FIG. 1) may be discs of greater diameter than the width of the plane which then extends through diametrical slots in the stabiliser discs. Again the discs may be inflatable.

Figure 4:
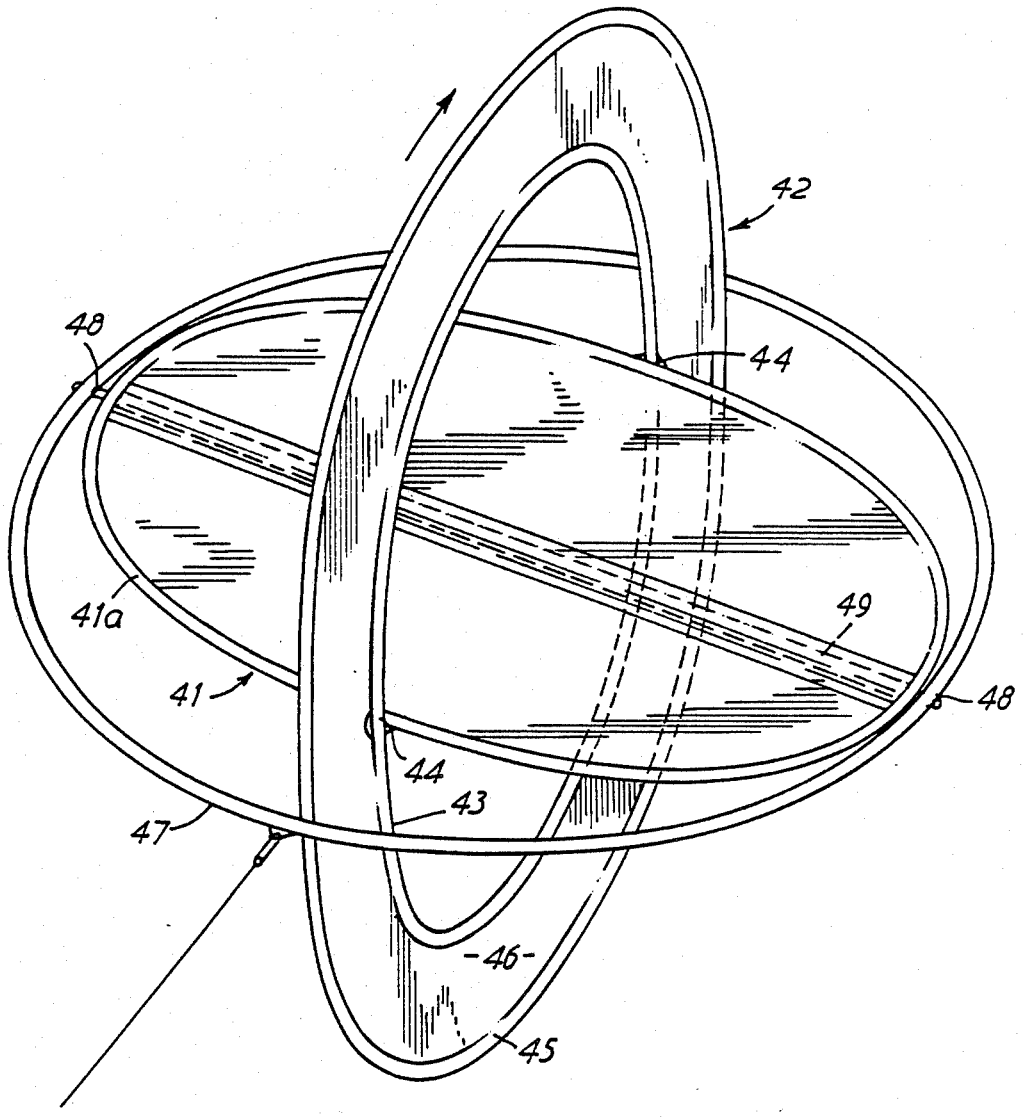

In the form of device show in FIG. 4, the stabiliser fin 42 is angular and comprises an inner ring 43 hinged to the wing 41 at diametrically opposite points thereof at 44. The stabiliser fin 42 also has an outer ring 45, the rings 43 and 45 being typically of glass fibre reinforced plastic, and an angular web portion 46 of thin plastics film. A pivotal connection 44 between the inner stabiliser ring 43 and the peripheral frame **41*a* ensure that the stabiliser ring 42** is free to take up an appropriate attitude in flight.

In the embodiment shown in FIG. 4, the flexible bridle is replaced by a rigid bridle 47 which may be in the form of a complete hoop as shown, extending through 360° around the device or merely a half hoop extending between the two end bearings 48 for the central rod 49 of the wing 41.

Figure 5:
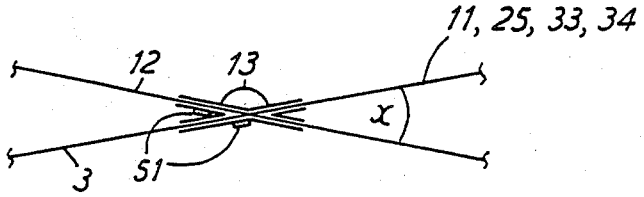
FIG. 5 shows in section, on the line V—V of FIG. 1, a modification.

FIG. 5 shows a modification which may be made to the embodiments shown in FIGS. 1 to 3 in the region of the hinge between the or each stabiliser 11, 25, 33 or 34 and the wing 1, 21 or 31. Two blocks or strips of cushioning material, for example of self-adhesive foamed plastics strip 51 are secured either to the stabiliser or to the wing with the strips on opposite sides of the wing or stabiliser but on the same side of the stabiliser or wing respectively. Thus, as shown in FIG. 5 the two strips are on the same side of the wing but on opposite sides of the stabiliser fin.

The effect of the cushioning blocks or strips 51 (which may conveniently be covered by the hinge tape 13) is to prevent the stabiliser fin or fins from folding completely flat against the wing. Accordingly, in the rest position immediately before flight, the wing and stabiliser are at a minimum angle x° as shown in FIG. 5.

The same result may be achieved by the use of resilient means, for example by tying the center of an elastic line, as indicated at 55 in FIG. 1, to one peripheral frame (i.e. of the wing or stabiliser) and the twoends of the elastic line to the other peripheral frame (i.e. of the stabiliser or wing, respectively). The two lengths of elastic line are sufficiently long to ensure that the stabiliser fin can hinge freely relatively to the wing in the range of positions around that in which they are at right angles to each other.

Smaller versions of the devices described above may be flown as kites. The hoop or half hoop arrangement described with reference to FIG. 4 may be applied to any of the other embodiments. The hoop or half hoop may be fixed to the upper end of a resiliently flexible pole, such as are available in telescopic form as long fishing rods and may thus be used to form an eye-catching advertising device.

Larger forms of the devices may be used to carry loads for example when paravaning.

As a result of the freedom of the stabiliser fins in each of the embodiments described above to adopt its correct position and as the result of the absence of any bracing wires or struts for holding them rigidly in position, I have found that the devices fly better with less drag tension on the anchoring line.

I claim:

1. An aerodynamic device, comprising:

a rotor coupled to retaining means which define an axis of rotation for the rotor;

a stabiliser fin carried on said rotor;

means interconnecting said stabiliser fin and rotor for assuring the capability of free hinging movement of said stabiliser fin through a range of angles with respect to said rotor during flight, said interconnecting means including hinge means hingedly connecting said stabiliser fin on the rotor for free angular movement about a hinge axis which lies in a plane normal to the rotation axis, the arrangement being such that in flight the stabiliser fin is free to move angularly about said hinge axis under effect of centrifugal and aerodynamic forces.

2. The device of claim 1 in which said interconnecting means includes means for preventing said stabiliser fin from lying flat against said rotor, yet permitting angular movement of said stabiliser fin through said range of angles, said range of angles extending in opposite directions from a stabiliser fin orientation at right angles to said rotor.

3. The device of claim 1 in which said rotor is a flat wing.

4. The device of claim 3 in which said interconnecting means includes means for preventing said stabiliser fin from lying flat against said rotor, yet permitting angular movement of said stabiliser fin through said range of angles, said range of angles extending in opposite directions from a stabiliser fin orientation at right angles to said rotor.

5. The device of claim 4 in which said preventing means comprises cushioning means operative with said stabiliser fin at less than a narrow acute angle (x) to said rotor to resiliently resist pivoting of said stabiliser fin closer to a position flat against said rotor but inoperative to influence the angle of the stabiliser fin with respect to said rotor when the latter angle is an acute angle substantially exceeding said narrow acute angle (x).

6. The device of claim 5 in which said cushioning means is in block or strip form adjacent said hinge means hingingly interconnecting said wing and said stabiliser fin.

7. The device of claim 3, in which said wing includes a stiffening rod having an axis defining the axis of rotation of said wing.

8. The device of claim 2 in which said preventing means are resilient.

9. The device of claim 8 in which said resilient means comprise elastic line urging said stabiliser fin away from said rotor while leaving said stabiliser fin to hinge freely in opposite directions away from its said orientation at right angles to said rotor.

10. An aerodynamic device, comprising:

a rotor coupled to retaining means which define an axis of rotation for the rotor;

a stabiliser fin connected to said rotor along a hinge axis;

means for maintaining the stabiliser fin free to pivot through a range of angles about said hinge axis in response to centrifugal and aerodynamic forces in flight, said range of angles extending in both angular directions from a fin position perpendicular to said rotor, said maintaining means including hinge means hingedly connecting said stabiliser fin on said rotor.

11. The device of claim 10 in which said maintaining means permits said fin to at least approach being folded flat against said rotor.

12. The apparatus of claim 10 in which said rotor comprises a wing having a peripheral frame formed from a glass fiber reinforced rod and having a substantially elliptical shape, said rotor further comprising a wing covering of thin plastics film secured around its edges to said frame by adhesive means, said retaining means comprising a stiff rod extending centrally along said flat wing in the length direction of the latter and having ends projecting beyond said frame, said retaining means further including a bridle secured to the ends of said rod for rotation of said rod with respect thereto, said stabiliser fin being located midway along said rod and frame, said hinge means comprising a flexible adhesive tape extending along said hinge axis and having side-by-side portions respectively fixed to said wing and stabiliser fin.

13. The device of claim 10 in which said rotor is tubular and formed of two sheets of stiff but resilient plastics material which are secured together along their edges to form a flattened tube, said retaining means comprising a stiff rod which passes for free rotation through said flattened tube and has ends exiting therefrom at the mid points of respective ones of said edges, said stabiliser fin comprising a pair of planar members connected along respective hinge axes to outboard faces of the respective two sheets, said hinge axes extending parallel to said edges of said sheets and being centered between said edges, said flattened tube having a storage position in which said two sheets are in face to face contact, said flattened tube including slide bushing means at said edges and receiving said stiff rod slidably therethrough for expansion of said flattened tube in a direction perpendicular to said edges and rod, in response to increasing rotational speed of the rotor when flows in a wind, so as to at least approach a cylindrical shape.

14. The apparatus of claim 10 in which said rotor comprises a flat wing of extended length and generally elliptical form, the central portion of said wind being generally parallel sided, a pair of said stabiliser fins being provided, with their corresponding hinge axes being parallel to each other and disposed substantially at the ends of said parallel sided central portion, said pair of stabiliser fins each being of generally oval shape and intersected at their middle by said flat wing, said hinge means being structured to permit said fins to freely tip toward and away from each other.

15. The device of claim 10 in which said retaining means comprises a rigid bridle in the form of at least a half circular hoop, and a rigid rod connecting diametrally thereacross, said rotor comprising a flat wing of generally elliptical shape, said rod being secured along the length axis of said elliptical shape, said stabiliser fin comprising a flat annular member of washer-like configuration having an inner peripheral edge defining a central opening therethrough, said flat wing extending through said central opening at a diameter of said annular member, said hinge axis lying along said diameter, said annular member extending outward along said diameter toward said bridle but being spaced from the latter so as not to interfere therewith, said washer-like annular member and said wing and said hoop being relatively pivotable about said rotation axis and hinge axis.

* * * * *

UNITED STATES PATENT AND TRADEMARK OFFICE

CERTIFICATE OF CORRECTION

PATENT NO. : 4 779 825

DATED : October 25, 1988

INVENTOR(S) : Kenneth SAMS

It is certified that error appears in the above-identified patent and that said Letters Patent is hereby corrected as shown below:

Col. 5, line 14; change "flows" to ---flown---.

Signed and Sealed this

Twenty-third Day of May, 1989

*Attest:*

*Attesting Officer*

DONALD J. QUIGG

*Commissioner of Patents and Trademarks*